US012528628B2

(12) United States Patent
Hewes

(10) Patent No.: US 12,528,628 B2
(45) Date of Patent: Jan. 20, 2026

(54) LATCHING SNAP WRAP

(71) Applicant: Kristopher J. Hewes, Charlestown, NH (US)

(72) Inventor: Kristopher J. Hewes, Charlestown, NH (US)

( * ) Notice: Subject to any disclaimer, the term of this patent is extended or adjusted under 35 U.S.C. 154(b) by 0 days.

(21) Appl. No.: 18/435,060

(22) Filed: Feb. 7, 2024

(65) Prior Publication Data

US 2025/0250081 A1 Aug. 7, 2025

(51) Int. Cl.
*B65D 63/10* (2006.01)

(52) U.S. Cl.
CPC .... *B65D 63/1018* (2013.01); *B65D 2563/101* (2013.01)

(58) Field of Classification Search
CPC ..... B65D 63/1018; B65D 2563/101; B65D 85/04; B65D 63/04; B65D 2563/02; B65D 63/06; B65D 63/08; B65D 63/00; Y10T 24/1498
See application file for complete search history.

(56) References Cited

U.S. PATENT DOCUMENTS

| | | | | |
|---|---|---|---|---|
| 3,438,095 | A | 4/1969 | Evans | |
| 4,377,872 | A | 3/1983 | Daniell, Jr. | |
| 5,738,398 | A * | 4/1998 | Miano | B65D 63/1018 294/166 |
| 6,047,448 | A | 4/2000 | Arnold | |
| 6,073,315 | A | 6/2000 | Rasmussen | |
| 6,961,979 | B2 | 11/2005 | Wendle | |
| 8,615,849 | B2 * | 12/2013 | Rothbaum | H01F 7/0263 24/303 |
| 8,752,316 | B1 * | 6/2014 | Dipaolo | B62B 9/00 40/661.12 |
| 8,991,774 | B2 | 3/2015 | Hajduch | |
| 9,541,447 | B2 * | 1/2017 | Daton-Lovett | E21B 47/01 |
| 9,630,758 | B2 | 4/2017 | Kozminske | |
| 9,668,550 | B2 * | 6/2017 | Seo | A44C 5/08 |
| 9,802,742 | B1 | 10/2017 | Castro | |
| 9,944,111 | B2 * | 4/2018 | Elmore | B43K 23/00 |
| 10,299,576 | B2 | 5/2019 | Rose | |
| 10,435,214 | B2 | 10/2019 | Kuperus | |
| 10,604,317 | B2 | 3/2020 | Chmelar | |
| 12,067,904 | B2 * | 8/2024 | Appello | F16L 3/233 |
| 2013/0213428 | A1 * | 8/2013 | Manno | A45D 8/36 132/273 |

(Continued)

FOREIGN PATENT DOCUMENTS

WO 2018117887 A1 6/2018

*Primary Examiner* — Jack W Lavinder
*Assistant Examiner* — Louis A Mercado
(74) *Attorney, Agent, or Firm* — Lambert Shortell & Connaughton; David J. Connaughton, Jr.; Justin P. Tinger

(57) ABSTRACT

A latching snap wrap for securing bundles such as a wrapped cable is provided. The snap wrap has a base layer formed of an elongate, resilient, flexible material that allows the snap wrap be capable of two different positions. The first is a non-actuated position such that it has a widthwise curve, and is approximately linear in a lengthwise direction; the second is an actuated position such that it is curved in a lengthwise direction and approximately flat in the widthwise direction. The snap wrap further has connectors at each end to allow it to be secured in the actuated position around the items it is intended to secure.

14 Claims, 4 Drawing Sheets

(56) References Cited

U.S. PATENT DOCUMENTS

| | | | | |
|---|---|---|---|---|
| 2014/0274614 | A1* | 9/2014 | Newman | A63B 21/4035 482/139 |
| 2015/0119963 | A1* | 4/2015 | Cosse | F25D 5/02 126/263.08 |
| 2015/0165338 | A1* | 6/2015 | Choe | A63H 33/18 446/46 |
| 2016/0157591 | A1 | 6/2016 | Gadams | |
| 2016/0375295 | A1* | 12/2016 | Brasch | A63B 21/0728 482/107 |
| 2019/0118074 | A1* | 4/2019 | Heringer | A63F 3/0023 |
| 2019/0246614 | A1* | 8/2019 | Healy, Jr. | A01K 97/00 |
| 2019/0365003 | A1* | 12/2019 | Barton | A41D 27/24 |
| 2022/0349435 | A1* | 11/2022 | Dimitrov | B65D 63/02 |

* cited by examiner

LATCHING SNAP WRAP

BACKGROUND OF THE INVENTION

The present invention relates generally to tying, wrapping, and harnessing tools. More specifically, the present invention relates to a single handed, reusable cable wrap.

When coiling a cable or hose or something of the like, it is often necessary to apply a wrap of sorts so that the coil maintains its shape. Similarly, with more and more electronic devices, wires and cables proliferate throughout the home and workspace. Wrapping these cables together allows for organization and reduction in messiness, tangles, and the like.

Simple, inexpensive devices that presently solve this dilemma generally require the user to use two hands, yet one hand is often required to maintain the intended shape of the coil whilst the wrap is applied. Further, many present devices are only intended for a onetime use; so that when the coil is to be uncoiled, the device must be removed, often forcefully, and disposed of. This removal process often requires an extra tool such as cutters.

Therefore, what is needed is an inexpensive and reusable device which conveniently allows cables to be wrapped with one hand, which allows a coil to maintain its shape whilst the harnessing device is applied, and that can easily be removed without additional tooling.

SUMMARY OF THE INVENTION

The subject matter of this application may involve, in some cases, interrelated products, alternative solutions to a particular problem, and/or a plurality of different uses of a single system or article.

In one aspect, a latching snap wrap assembly and system for securing bundled items is provided. The device is generally described herein as a snap wrap, and may have a base formed of a flexible material. The base is formed to allow the snap wrap to have a first unactuated position with a widthwise arc, and a second actuated position with a lengthwise curve and being flat along its width. The first unactuated position is for storage operation, and the actuated position is for use to wrap items. The snap wrap further has a first connector attached to a top surface of the base, and a second connector attached to a bottom surface of the base, on an opposite lengthwise side of the base (i.e. opposite side of a lengthwise center of the base). The two connectors engage with each other when the snap wrap is in the actuated position to further hold the ends of the snap wrap together for a secure wrapping of whatever is contained within the snap wrap. The device is secure, reusable, and easily stored when not in use.

In another aspect, a wrapped assembly is provided. The wrapped assembly includes a bundle of cable, cord, wire, hose, and the like. The bundle is held together by one or more latching snap wraps in an actuated position. The one or more latching snap wraps each having a base made of a flexible material. The base is formed to allow the snap wrap to have a first unactuated position with a widthwise arc, and a second actuated position with a lengthwise curve and being flat along its width. The first unactuated position is for storage operation, and the actuated position is for use to wrap items. The snap wrap further has a first hook and loop connector portion attached to a top surface of the base, and a second hook and loop connector portion attached to a bottom surface of the base, on an opposite lengthwise side of the base (i.e. opposite side of a lengthwise center of the base). The two connectors engage with each other when the snap wrap is in the actuated position to further hold the ends of the snap wrap together for a secure wrapping of the bundle. As configured in the actuated position, the base defines an enclosed space which surrounds (i.e. encircles) a portion of the bundle and holds it together.

In yet another aspect, a method of securing a quantity of material together is provided. The method involves gathering material into a bundle. The material may include, but is not limited to an elongate element or elements such as wires, cables, cords, hose, sticks or brush and other elongate items, and the like. The material may then be secured together using the latching snap assembly disclosed herein. In the unactuated position, a user may urge a convex bottom surface of the snap wrap against the bundle by, for example, swinging it against the bundle, or pushing it forcefully against the bundle. This force causes the widthwise arc surface to flatten out, which in turn causes the base to move to its actuated position having a lengthwise curve, at which point the movement to actuated position automatically causes the two connectors to engage, securing to each other and holding the latching snap wrap in place.

DETAILED DESCRIPTION OF THE INVENTION

Figure 1:
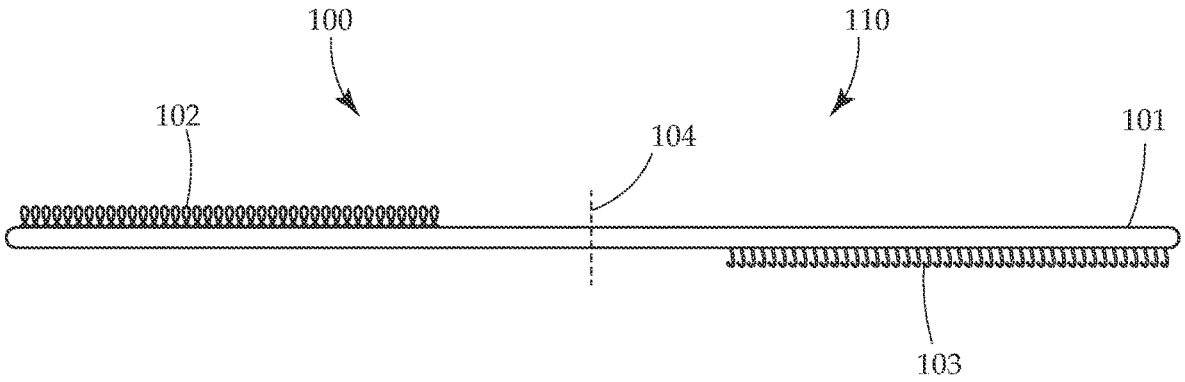
FIG. 1 provides a side view of an embodiment of the present disclosure.

The detailed description set forth below in connection with the appended drawings is intended as a description of presently preferred embodiments of the invention and does not represent the only forms in which the present disclosure may be constructed and/or utilized. The description sets forth the functions and the sequence of steps for constructing and operating the invention in connection with the illustrated embodiments.

One primary goal of the latching snap wrap of the present disclosure is to provide a reusable harnessing or wrapping tool designed for single-handed use. This versatile latching snap wrap tool is intended for various applications such as harnessing, storage, tying, sealing, and manufacturing.

Generally, the present disclosure has a base layer made of resilient, flexible material with a patch of loops on one face, and a patch of hooks on the opposite face. Of course, other connector structures may also be used other than the hook and loop configuration disclosed herein. The base layer maintains a linear orientation with a widthwise curve ("arc") when unactuated and extended, and transforms into a lengthwise curved or coiled orientation with a flat width in its actuated position. In many embodiments, the base of the snap wrap is a metal bistable spring to achieve the noted structural changes. The base material may be formed of any flexible, resilient material, and is typically formed of a metal or plastic. In a particular embodiment, the base may be formed as a stainless steel bistable spring strip or band or a spring steel bistable spring strip or band, among other options.

The latching snap wrap is designed to hold things such as a wrapped or coiled elongate item or a bundle of items, such as a hose, wire, cord, cable, sticks or other elongate items, and the like. As used herein, the term bundle may refer to any structure capable of being encircled by or held together with the presently disclosed latching strap wrap.

While described as a curve or arc herein, the widthwise shape may be any concave shape, such as an upward arc, upward curve of any design, upward 'V' shape, and the like without straying from the scope of this invention. The term widthwise curve or arc is used herein to refer to any of these various shapes as well. Similarly, the lengthwise curve shape may be not only a continuous curve, but any other concave wrapping or curving shape, including having angles, different curvature arcs along the length, and the like. The term lengthwise curve or arc is used herein to refer to any of these various shapes as well.

To bring the snap wrap from the unactuated position to an actuated position for wrapping, the widthwise arc of the base layer is deformed towards a flat position, which leads the material to bend along its length to its actuated position. The deformation may be achieved in any manner. In one example, it may be deformed by slapping or otherwise urging the device against the object to be harnessed. In the actuated position, the patch of hooks securely engages with the patch of loops, effectively latching onto the item. Once the hook and loop or other connectors are engaged, the snap wrap will not be released accidentally or otherwise unintentionally separate under normal conditions.

In the unactuated position, the base layer's bottom face is convex, formed by the widthwise upward arc, while the top face is concave. In one embodiment, the top face has a patch of loops, and the bottom face has a patch of hooks; and in an alternative embodiment, this configuration is reversed.

Various parameters, including length, width, widthwise arc, and thickness of the base layer, can be adjusted to accommodate different bundle sizes, vary the force needed to deform the widthwise arc, and account for diverse hook and loop patch sizes.

In embodiments having hook and loop connectors as the first and second connector, the size and positioning of the hook and loop patches are designed to facilitate smooth latching during the transition to the actuated position and to control the latching force when in the actuated position. In a preferred embodiment, the hook and loop connectors are sized and configured to automatically engage as soon as the snap wrap moves to the actuated position. In storage embodiments, these hook and loop patches may be used to attach the device to external loops and/or hooks, allowing it to be hung in both unactuated and actuated positions, with or without a harnessed item. For example, in the actuated position, the hook and loop connectors may be sized and configured to be secure enough to support a wrapped bundle such as a hose, extension cord, wire, and so forth when the base is hooked on a storage hook. In another embodiment, in the unactuated position, one side of the hook and loop connector may be attached to a corresponding hook and loop connector on a storage area. In another embodiment of storage, the unactuated position snap wrap can be easily stacked by virtue of its widthwise arc matching a widthwise arc of a base above and/or below.

The hook and loop patches may be made of common materials like nylon and attached using various methods such as pressing, gluing, taping, stamping, or sewing. Connector size and configuration, including hook and loop patch size may vary, and the first and second connectors may extend along different or the same lengths of the base. For example, a loop patch portion of a hook and loop connector may be much larger than the hook patch portion, such that the hook patch may connect at various different places. A similar structure may also be reversed. In another embodiment, the hook patch and loop patch may extend for the entire length of the base on opposite sides. In an even further embodiment, one or both of the hook and loop patches may extend beyond the length and/or width of the base.

While hook and loop connector embodiments are largely discussed herein, the connector structure may vary and may be any structure capable of engaging together to prevent unintentional separation of the ends of the base when in the actuated position. Other examples include, but are not limited to magnets, ramps or other interfacing or mating faces, and the like.

Edge guarding materials, including fabric, silicon, plastics, rubbers, nylon, or leather, may be added to cover sharp edges. In embodiments having a covering layer over the base layer, such as polymer, the connectors, such as the hook and loop connector patches, may be directly attached or molded into the covering layer.

Alternative embodiments may feature etched or printed designs on the base layer. Alternatively, design materials like fabric, silicon, plastics, nylon, or leather may be added to the hook and/or loop patches, along with edge guarding materials, if desired, to improve the design and appearance of the latching snap wrap. Edge guarding materials and or a cover layer over the base may or may not be present in such an embodiment.

Importantly, the snap wrap of the present disclosure is specifically configured to be operable with a one-handed operation allowing easy actuation by a slapping or urging motion against the wrapped bundle or other item for the snap wrap to be connected to. It is also designed to allow for easy and neat storage (such as stacking, hanging on a hook or by one of the connectors, and the like) and reusability. While other structures have been disclosed to wrap things like cables, they do not allow for one handed operation, are not re-usable, and are not secure enough for adequate holding of heavy items such as a hose, extension cord, heavy cables, multiple cables, and the like. For example, certain structures in the prior art lack adequate end connectors, which may allow for the wrap to come apart under stress or forces.

Turning now to FIG. 1 a side view of (either left or right, which are symmetrical in this embodiment) of an embodiment of the latching snap wrap. The latching snap wrap 100 has a base 101 shown in its unactuated position 110 having a substantially straight length and widthwise curve (see FIG. 2). Two connectors 102 and 103 are attached to the base, one on the top of the base and one on the bottom. In this view, the connectors 102, 103 are a patch of loops 102 and a patch of hooks 103 which mate together as hook and loop connectors. Of course, other connecting structures may be used. In this embodiment, the connectors 102, 103 are on opposite sides of a lengthwise center 104 of the base 101. In other embodiments, the connectors 102, 103 may extend further beyond the lengthwise center 104 including covering the entire top/bottom surface, and in some cases may extend further beyond the edge of the base 101. In other embodiments, the connectors 102, 103 may be in the form of a plurality of spaced apart strips on a side of the base 101 rather than a single strip.

Figure 2:
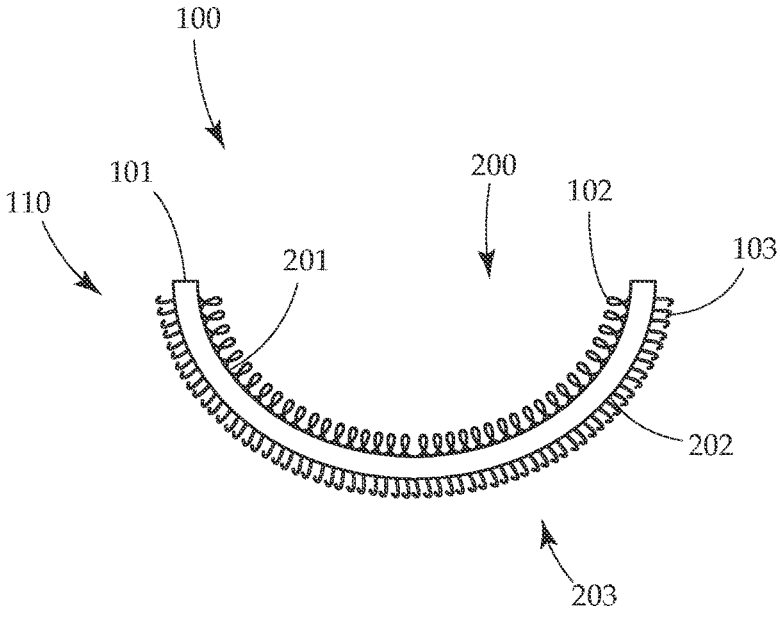
FIG. 2 provides a front view of an embodiment of the present disclosure.

FIG. 2 shows another embodiment of the latching snap wrap 100 from a front view (which also looks the same from the rear view). Here, the widthwise arc (also called "curve") 200 can be seen. In this view, the latching snap wrap is in an unactuated position, similar to FIG. 1. When actuated, the structure trades the curve across the width with a curve along the length—as is the nature of a bistable spring. The base 101 has a concave upper side 201 and a convex lower side 202. Application of a deforming force 203 such as by "slapping" i.e. forcefully swinging the convex lower side against something will cause the widthwise arc 200 of the base 101 to flatten, which then actuates the curved linear shape to bring the base 101 to the actuated position (FIGS. 5 and 6).

When dimensioning the base layer 101, considerations are made for these characteristics to accommodate varying sizes of items to harness, varying holding forces, varying deforming properties, varying designs, and other varying physical and/or chemical properties relating to the device's lifespan. Additionally, the length, width, widthwise arc 200, and thickness of the latching snap wrap's 100 base layer 101 may vary to optimize the manufacturing of the device, and/or the use of the device in specific applications such as but not limited to applying the device to a bundle of cables in a manufacturing setting.

Figure 3:
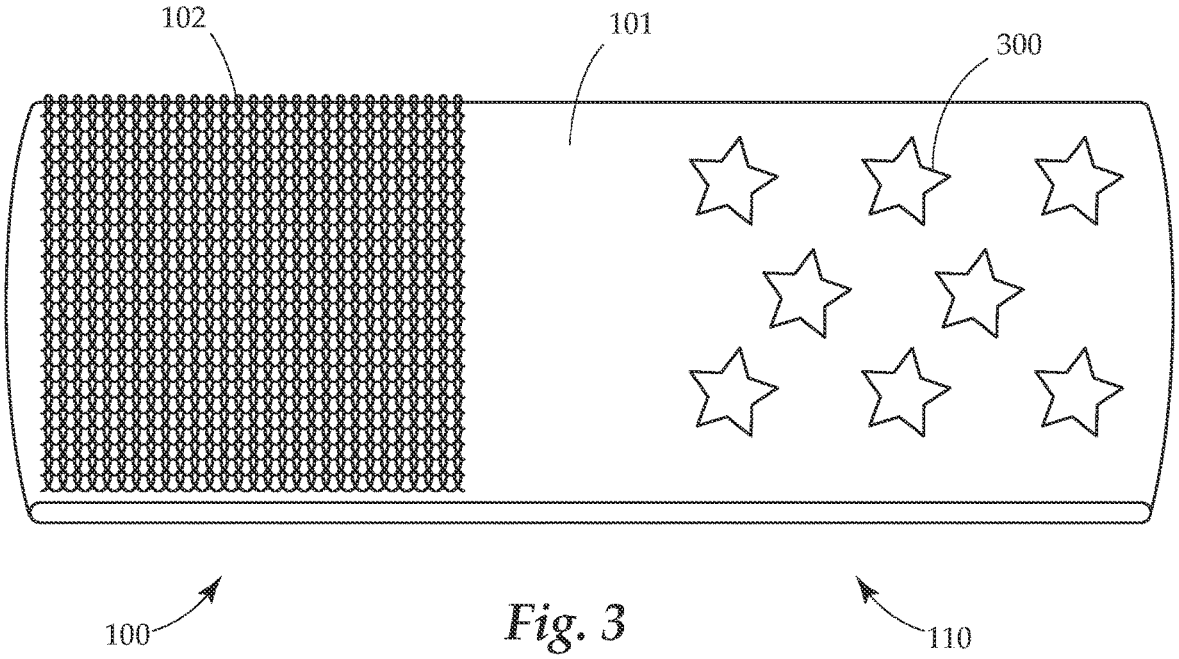
FIG. 3 provides a top view of yet another embodiment of the present disclosure.
Figure 4:
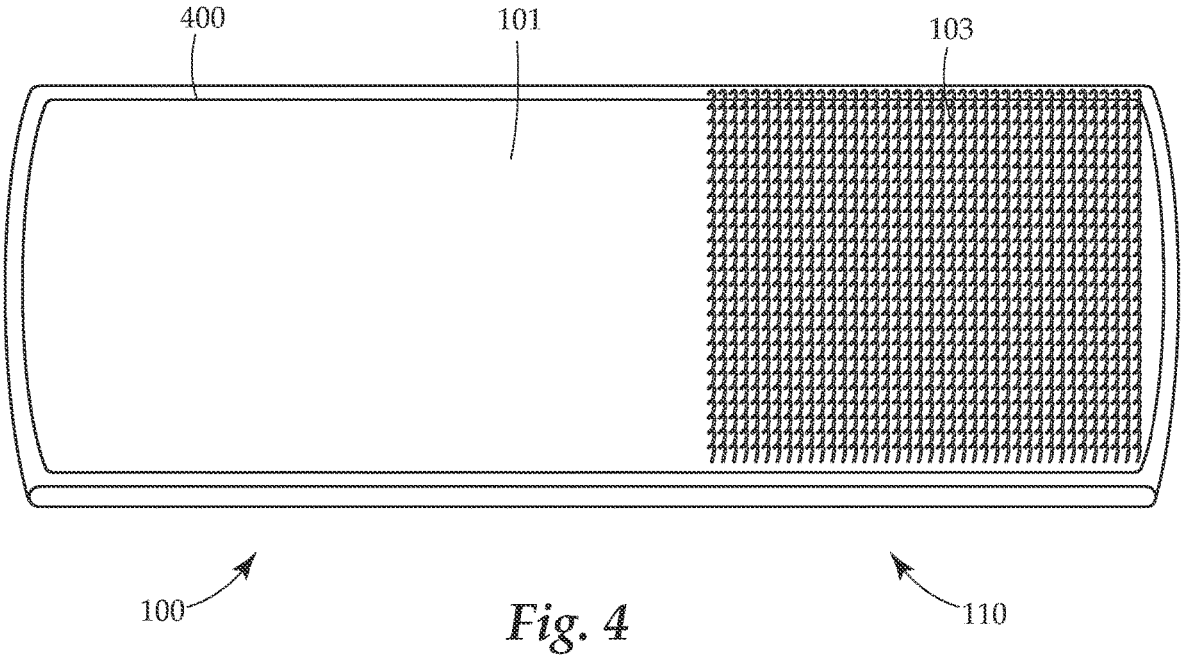
FIG. 4 provides a bottom view of still another embodiment of the present disclosure.

FIGS. 3 and 4 show embodiments of a top side and a bottom side of the latching snap wrap 100. A top view in FIG. 3 shows the loop connectors 102 as well as an exterior covering layer 300 which has a decorative design printed or otherwise marked thereon. In other embodiments, instructions or warnings may also be marked thereon. FIG. 4 provides a bottom view and shows a covering layer 400 surrounding the base 101. Covering layer may be any material, including paint or, in many cases, a polymer to provide durability, grippiness and a comfortable working surface, protection from sharp edges, and a surface on which for the connectors 102, 103, to attach. The hook patch 103 can also be seen in this view.

Figure 5:
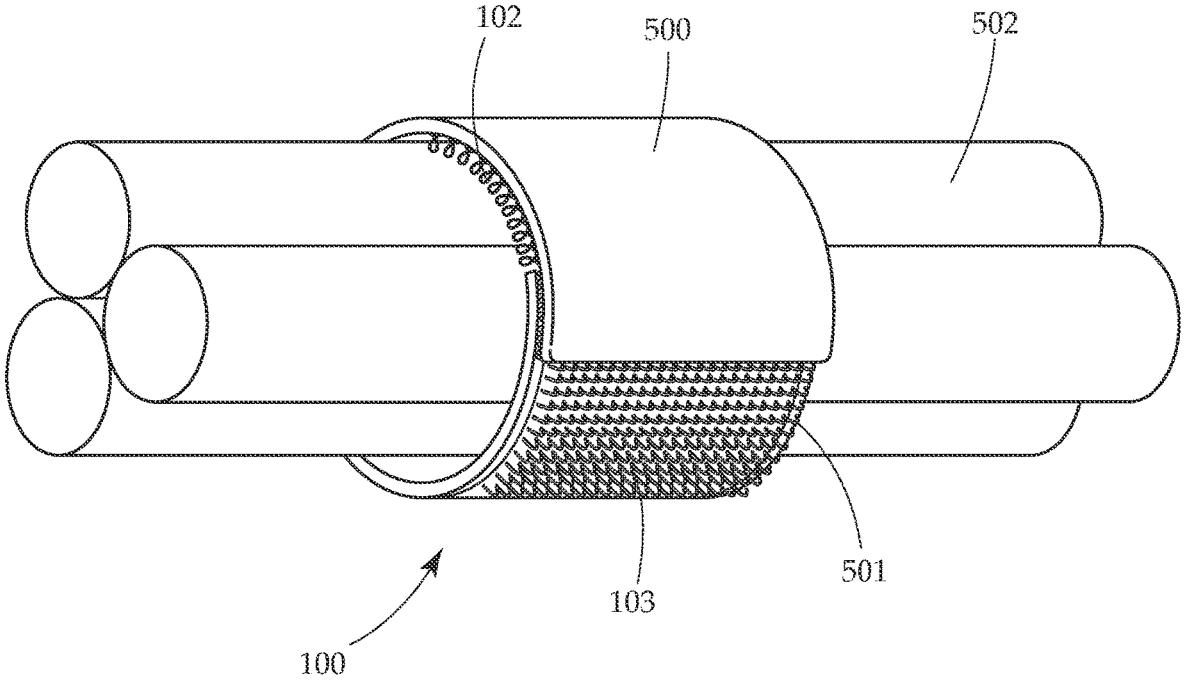
FIG. 5 provides a perspective view of an embodiment of the present disclosure in use.
Figure 6:
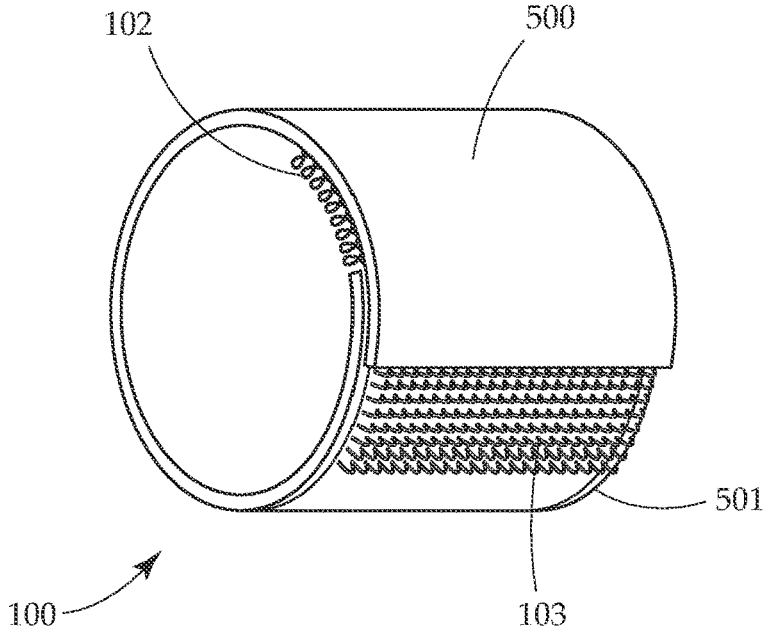
FIG. 6 provides a perspective view of still yet another embodiment of the present disclosure.

FIGS. 5 and 6 show a wrapped assembly using the latching snap wrap. Here, the latching snap wrap 100 is shown in an actuated position 500 which has a flat widthwise orientation and a curved lengthwise base 101. The latching snap wrap 100 covers or otherwise encircles a bundle 502 which as noted may be things like a wrapped cable, hose, wire, elongate item, sticks, tools, and so forth. The hook and loop connectors 102, 103, are latched together at 501 which prevents separation of the ends of the base 101. Because hook and loop connectors are particularly strong at preventing removal in lateral shearing directions such as side to side or lengthwise, they are a particularly suitable choice for this invention.

Figure 7:
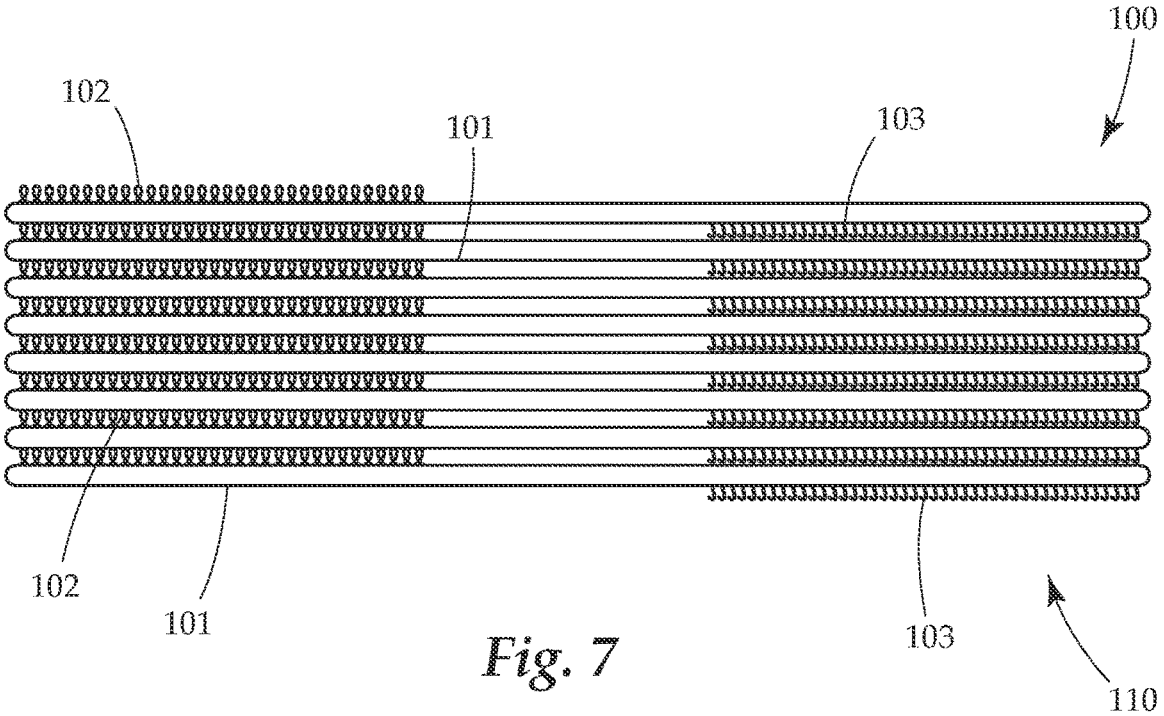
FIG. 7 provides a side view of a plurality of devices stacked on top of each other in a stored embodiment.

FIG. 7 provides a view of a storage or packaging embodiment of the latching snap wrap 101 in an unactuated and stacked position. The horizontal arc 200 of the base 101 in the unactuated position makes it suitable for a stacking storage solution as the arcs fit closely and securely together without tipping. Of course, other convenient storage or packaging solutions may be available such as connecting one connector of each latching snap wrap 100 to a connector base such as a long strip of loop patch (not shown), or moving the latching snap wrap to an actuated position and hooking it on a hook, wire, or other structure to pass through the inner area encircled by the base 101.

Figure 8:
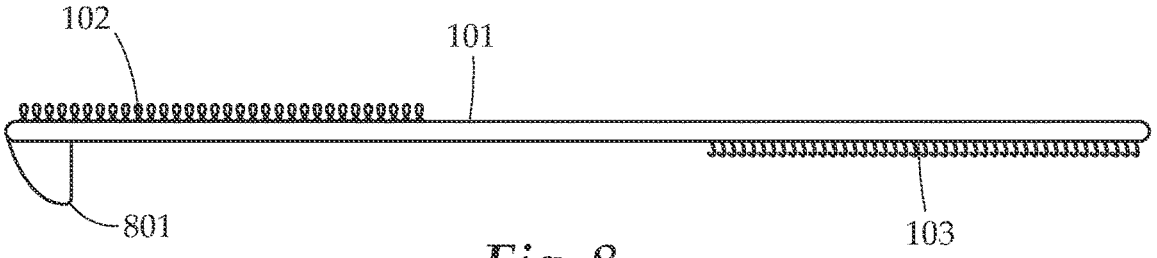
FIG. 8 provides a side view of another embodiment of the present disclosure.

FIG. 8 provides a view of another embodiment of the latching snap wrap. In this view, a ramp 801 extends from a bottom surface of the base 101. In some instances of use, when securing the device around a loosely held bundle of items, the end of the latching snap wrap may not coil around the entire bundle, but instead cut through the bundle and coil partly inside, leaving some items or wraps of the bundle unsecured. To solve this, the ramp 801 may be used to better gather the loosely wrapped items and to resist passing through spaces between the items of the bundle. The ramp shape also aids in a smooth transition of the base from unactuated to actuated position because the angle of the ramp urges the opposite end of the base 101 over it so that the connectors 102, 103 can engage together. The flat edge of the ramp 801 "scoops" or otherwise helps encircle the bundle, whether it is loose or not.

While several variations of the present disclosure have been illustrated by way of example in preferred or particular embodiments, it is apparent that further embodiments could be developed within the spirit and scope of the present disclosure, or the inventive concept thereof. However, it is to be expressly understood that such modifications and adaptations are within the spirit and scope of the present disclosure, and are inclusive, but not limited to the following appended claims as set forth.

What is claimed is:

1. A reusable latching snap wrap comprising:

a base formed of a flexible material having a first unactuated position with a widthwise arc;

wherein, the base remains straight along a lengthwise direction in the first unactuated position;

and a second actuated position with a lengthwise curve or coiled orientation, and being flat along its width;

wherein, the base is a metal bistable spring;

a first connector on a left end of a top surface of the base;

wherein, the first connector comprises a patch of loops;

a second connector on a right end of a bottom surface on an opposite side of a lengthwise center of the base from the first connector;

wherein, the second connector comprises a patch of hooks;

wherein, the second connector is symmetrically placed to the first connector with regard to the lengthwise center of the base, and has a same shape and size as the first connector;

wherein, the first and second connectors are shorter than half of the base in the lengthwise direction;

wherein the first connector automatically engages with the second connector when the base is in the second actuated position;

wherein, the base is operable to hold a bundle of elongated items in the second actuated position;

wherein, the base is able to switch from the first unactuated position to the second actuated position in response to being slapped against the bundle of elongated items;

one and only one ramp, located on a left end of the bottom surface of the base, having a rounded left surface extending to a left edge of the base, and a flat right surface perpendicular to the base, operable to gather the bundle of elongated items together and prevent the base from passing through the bundle of elongated items.

2. The latching snap wrap of claim 1 wherein the first connector covers less of a length of the base than the second connector.

3. The latching snap wrap of claim 1 wherein the second connector covers less of a length of the base than the first connector.

4. The latching snap wrap of claim 1 further comprising a wrap layer around lengthwise edges of the base.

5. The latching snap wrap of claim 4 further comprising a wrap layer around widthwise edges of the base.

6. The latching snap wrap of claim 1 further comprising a protective layer covering an entire outer surface of the base.

7. The latching snap wrap of claim 6 wherein the first connector is directly attached to the protective layer, and wherein the second connector is directly attached to the protective layer.

8. The latching snap wrap of claim 1 wherein the base is movable from the first unactuated position to the second actuated position upon application of a force along a convex lower portion of the base.

9. The latching snap wrap of claim 1 wherein the bundle of elongated items is a cord or hose bundle.

10. A wrapped assembly comprising a bundle of cable, cord, wire, or hose, or a plurality thereof, the bundle being held together by a latching snap wrap in an actuated position, the latching snap wrap comprising:

a base formed of a flexible material having a first unactuated position with a widthwise arc; and a second actuated position with a lengthwise curve and being flat along its width;

a first connector on a top surface;

a second connector on a bottom surface on an opposite side of a lengthwise center of the base from the first connector;

wherein the first connector engages with the second connector when the base is in the second actuated position;

wherein the first connector is a plurality of loops and the second connector is a plurality of hooks, to form a hook and loop connector;

the base defining an enclosed space to surround a portion of the bundle in the second actuated position;

one and only one ramp, located on a left end of the bottom surface of the base, having a rounded left surface extending to a left edge of the base, and a flat right surface perpendicular to the base, operable to gather a bundle of elongated items together and prevent the base from passing through the bundle of elongated items.

11. The wrapped assembly of claim 10 wherein the first connector is directly attached to a protective layer, and wherein the second connector is directly attached to a protective layer.

12. The wrapped assembly of claim 10 wherein the base is formed of a metal bistable spring.

13. The wrapped assembly of claim 10 wherein the first connector and the second connector have different lengths.

14. A method of securing a quantity of material together comprising the steps of:

gathering the material into a bundle, and securing the material together using a latching snap wrap by urging a bottom surface of a base of the latching snap wrap against the bundle, the urging causing the latching snap wrap to move to an actuated position wrapped about the bundle;

securing a first connector and a second connector of the latching snap wrap together;

wherein, the latching snap wrap includes the base and one and only one ramp, located on a left end of the bottom surface of the base, having a rounded left surface extending to a left edge of the base, and a flat right surface perpendicular to the base, operable to gather a bundle of elongated items together and prevent the base from passing through the bundle of elongated items.

* * * * *